United States Patent [19]

Gruller

[11] 4,408,783

[45] Oct. 11, 1983

[54] HOLDDOWN APPARATUS

[75] Inventor: David L. Gruller, Houston, Tex.

[73] Assignee: Smith International Inc., Newport Beach, Calif.

[21] Appl. No.: 219,252

[22] Filed: Dec. 22, 1980

[51] Int. Cl.[3] ..... F16L 35/00

[52] U.S. Cl. ..... 285/3; 285/24; 285/39; 285/142; 285/315; 285/321; 166/88; 166/217

[58] Field of Search ..... 166/83, 86, 87, 88, 166/217; 285/18, 140, 141, 142, 143, 308, 315, 321, 39, 3, 24

[56] References Cited

U.S. PATENT DOCUMENTS

| | | | |
|---|---|---|---|
| 3,222,089 | 12/1965 | Otteman | 285/18 |
| 3,250,331 | 5/1966 | Boyle | 285/315 X |
| 3,273,646 | 9/1966 | Walker | 166/86 |
| 3,341,227 | 9/1967 | Pierce | 285/321 X |
| 3,404,736 | 10/1968 | Nelson et al. | 285/142 X |
| 3,468,558 | 9/1969 | Ahlstone | 285/321 X |
| 3,468,559 | 9/1969 | Ahlstone | 285/18 |
| 3,489,436 | 1/1970 | Ahlstone | 285/18 |
| 3,492,026 | 1/1970 | Ahlstone | 285/18 |
| 3,528,686 | 9/1970 | Nelson | 166/87 X |
| 3,540,533 | 11/1970 | Morrill | 166/387 |
| 3,664,689 | 5/1972 | Hanes | 285/18 |
| 3,800,869 | 4/1974 | Herd et al. | 166/368 X |
| 3,809,158 | 5/1974 | Bonds et al. | 285/18 X |
| 3,827,488 | 8/1974 | Piazzu et al. | 166/87 |
| 3,918,747 | 11/1975 | Putch | 285/4 |
| 4,046,405 | 9/1977 | Bonds | 285/141 X |
| 4,124,233 | 11/1978 | Ahlstone | 285/308 X |
| 4,138,144 | 2/1979 | Pierce | 285/18 |

*Primary Examiner*—Dave W. Arola

*Attorney, Agent, or Firm*—Ned L. Conley; David Alan Rose; Murray Robinson

[57] ABSTRACT

A holddown assembly is mounted on a hanger suspending a string of casing or tubing into a well. A shoulder on the hanger engages a seat in the bore of the wellhead and has passages therethrough for connecting the annular spaces above and below the seat. The holddown assembly includes a rigid, radially expansible locking ring having an upwardly facing tapered surface, and a cam ring having an annular tapered surface for camming cooperation with the locking ring surface. The locking ring is disposed on the hanger shoulder opposite an internal groove in the wellhead. The cam ring threadingly engages the hanger and is releasably attached to the running tool whereby upon rotation of the running tool, the cam ring moves downwardly on the hanger threads and no seals are associated with the holddown assembly. The holddown assembly provides a positive holddown and permits locking the hanger down before, during, or after the cementing operation.

16 Claims, 5 Drawing Figures

HOLDDOWN APPARATUS

TECHNICAL FIELD

This invention relates to underwater casing hanger apparatus, and more particularly, to holddown apparatus for locking within a wellhead a casing hanger suspending a string of casing or tubing.

BACKGROUND OF THE ART

In the drilling of an underwater oil and gas well, it is common to install a series of coaxial casing assemblies extending into the ocean floor to different depths and suspended by a casing hanger mounted at the mudline within the wellhead or a hanger head disposed within the wellhead. An inner hanger apparatus will have a first device for automatically engaging a second device on the wellhead or an outer hanger head, as the case may be, during the time such inner hanger, suspending a string of tubing or casing, is being lowered into the well and so as to prevent further downward movement of such inner hanger and string. Such hanging means may include spring operated latches as the first device for cooperating with grooves as the second device, as shown in U.S. Pat. No. 3,800,869; or may include a generally downwardly facing seat as the first device for resting on a generally upwardly facing seat as the second device, as shown in U.S. Pat. No. 3,809,158.

In such installations, pressure control equipment is connected to the upper end of the wellhead, and the string is lowered into the well through such equipment for suspension from the wellhead. To lower the string, the hanger, connected to the upper end of the casing or tubing string, has means thereon for releasable connection to a running tool suspended from the lower end of a pipe string extending to the surface, and, as discussed above, a seat about the hanger for landing on a seat in the bore of the wellhead as it is lowered by the tool, the coaxial casings forming an annulus.

Although reliance may be had on the weight of the casing or tubing to hold the hanger down within the well after it has landed, generally it is desirable to lock the hanger and string. Conventionally, means for locking the respective casing hangers in the wellhead housing are carried by the wellhead or outer hanger head and automatically interlock with an inner hanger when the inner hanger is landed within the wellhead. U.S. Pat. No. 3,528,686 discloses such an apparatus where the inner hanger has a downwardly facing tapered seat adapted to engage the upwardly facing seat on the surrounding head. Above the hanger seat is a reduced external diameter portion providing an upwardly facing shoulder adapted for engagement with the lower end of a lock ring mounted within an internal groove in the head. As the hanger moves past the lock ring housed in the groove, the lock ring is cammed outwardly into the groove. After the hanger moves past the groove, the locking ring contracts partially inward and above the hanger shoulder to lock the hanger in place and prevent its upward movement.

Various prior art patents disclose means for locking a hanger down within the wellhead including U.S. Pat. Nos. 3,273,646; 3,404,736; 3,468,558; 3,468,559; 3,489,436; 3,492,026; 3,528,686; 3,664,689; 3,800,869; 3,827,488; and 3,918,747. However, most prior art devices do not provide for a positive holddown where the locking ring or latch is prevented from expanding or contracting so as to unlock the hanger within the well.

Those which provide a type of positive holddown are in combination with a seal assembly where the positive holddown is not effected until the seal assembly is actuated. Such holddowns are then dependent upon the life of the seal ring in the assembly. See, for example, U.S. Pat. Nos. 3,404,736; 3,540,533; 3,664,689; 3,809,158 and 4,138,144.

Under some circumstances, it is desirable not to lock down the hanger or to have the hanger unlocked. This desirability does not always evidence itself until after the previously installed hanger head has been run and set in place. As a result, if the lock ring is present in the previously installed hanger head, the next hanger therefore will automatically be locked in place upon landing, even though it is later determined that locking is undesirable at that time. U.S. Pat. No. 3,664,689 avoids this problem by installing an optional filter ring around the inner hanger to prevent the locking ring from engaging the hanger shoulder so as to lock down the hanger. The '689 patent still has the disadvantage that the hanger must be pulled from the well to later lock the hanger down.

Most prior art holddown latches include a sealing assembly which is subjected to the deleterious effects of the circulating cement and returns during the cementing operation. See, for example, U.S. Pat. Nos. 3,404,736; 3,528,686; 3,540,533; 3,664,689; 3,809,158; 3,827,488; and 3,918,747. This is true even where the holddown assemblies are independent of the seal assemblies. See U.S. Pat. Nos. 3,468,558; 3,468,559; 3,489,436; 3,492,026; and 3,827,488. Although U.S. Pat. No. 3,273,646 does not subject its sealing assembly to circulation, neither does it provide a positive holddown during the cementing operation.

The cementing operation includes anchoring the hanger and string in place by means of the cement which is conducted downwardly through the handling string and upwardly into the annulus between the suspended string and the well bore. There are flow passages through the hanger which connect the annulus with the bore of the wellhead above the seat so that returns may be taken up through the flow passages.

The cementing of a casing string within a wellhead structure is a difficult operation that is both costly and time consuming. Among the difficulties is the problem of insuring a solid cementing operation of the casing string within the incased portion of the hole and still providing a reliable means of effecting a secondary seal at the hanger. Many cementing systems operate on a volumetric basis wherein a predetermined amount or volume of cement is pumped into the well and allowed to flow up around the casing string to permanently secure it in place. However, leaks or cracks in the wellhead structure or ruptured strata of the hole itself may drain off a portion of the cement thereby preventing an adequate cementing of the casing. Should this crack or leak occur near the bottom of the hole, virtually all the cement may be drained off or lost from the annulus around the casing, thereby putting greater reliance on the secondary seal at the hanger to prevent any leakage of down hole pressure.

Prior cementers using a return line for logging the height of the effective cement create still further problems. Cement is pumped down into the casing, out the bottom and into the annulus around the casing. To permit the cement to enter the return line or flow past the cementer, the cementer or casing hanger has to be raised up a sufficient distance to provide a flow path thereabout. When sufficient cement has passed the cementer, the cementer is allowed to settle back down to its intended position. The high specific gravity of liquid cement many times buoys up the casing hanger and prevents it from reassuming its correct position. Therefore, this process is not positive with the high probability that the casing string is not at the bottom of the well hole.

In some cases it is desirable to reciprocate, or repeatedly raise and lower, the casing during the cementing operation to increase the turbulance of the cement for a more complete cleanout of foreign material from the surfaces being cemented. After cementing, the hanger should be lowered to its seat and locked down during solidification of the cement.

Sealing off the cemented annulus around the casing is difficult in prior devices because the abrasive effect of liquids and solids displaced by cement sometimes rips or damages the seals, thereby preventing an effective seal. Furthermore, when seals are forced across threaded portions of the casing hanger, additional ripping, tearing or damage of the seals can occur.

U.S. Pat. No. 3,404,736 discloses an integral support ring/packoff assembly. This assembly includes an upper tubular member and a lower tubular member which are made up with one another by means of threads disposed about the upper end of the lower member and threads disposed about an intermediate portion of the upper member. The lower member has threads about its lower end for making up with intermediate threads on the hanger located above the annular seat supporting the hanger within the wellhead and below the running tool threads. The running tool threads are arranged radially inwardly on the hanger so that the lower tubular member is free to move downwardly over the running tool threads on the hanger and into position for engagement with the intermediate threads on the hanger.

The upper member is releasably attached to the running tool by means of pins projecting outwardly from the running tool for fitting within grooves about the upper end of the upper tubular member. These pins not only permit the entire assembly to be lowered onto the casing hanger, but also permit it to be rotated for anchoring thereto by the engagement of the intermediate hanger threads. The upper and lower tubular members are releasably connected against rotation related to one another by means of one or more shear pins so that a right-hand torque transmitted on the running tool by the drill string will be transmitted to the upper member and thus to the lower member for making up the intermediate threads on the hanger.

There is a frustoconical shoulder around the outer circumference of the lower tubular member positioned so as to be opposite an internal groove in the bore of the wellhead. There is a rigid split ring disposed above the shoulder on the lower member for radial expansion into the annular groove. An expander ring, which also functions as a lower compression ring for the seal assembly, has a cooperative tapered surface engaging a taper on the upper surface of the split ring where, upon the downward movement of the expander ring, the split ring is expanded radially outwardly into the annular groove to relieve the axial load of the hanger and string on the wellhead.

The seal assembly includes the expander ring as the lower compression member and a seal ring mounted around the lower tubular member and located above the expander ring. On top of the seal ring is an anti-friction ring whose upper surface engages the lower end of the upper tubular member.

To actuate the assembly, a right-hand torque is placed on the running tool causing the upper tubular member to move downwardly thereby expanding the split ring and energizing the seal ring. However, as has been pointed out, there is no positive holddown during the cementing operation and the support provided by the split ring is dependent upon the life of the seal ring. Further it should be noted that the purpose of the split ring is not to serve as a holddown but as an axial support to relieve part of the load on the hanger.

The device of the present invention includes a positive holddown independent of the packoff assembly. The positive holddown may be actuated for locking or unlocking any time between the loading of the hanger and the actuation of the packoff assembly. Such versatility is lacking in the prior art. Further, the present invention provides a positive holddown whereby the locking ring is locked into the wellhead groove and has no ability to expand or contract so as to become unlocked.

Other objects and advantages of the invention will appear from the following description.

DISCLOSURE OF THE INVENTION

The present invention includes a holddown assembly mounted on a hanger. The hanger suspends a string of casing or tubing for lowering same into a well on a running tool. A shoulder on the hanger engages a seat in the bore of the wellhead and has passages therethrough for connecting the annular spaces above and below the seat.

The holddown assembly includes a rigid, radially expansible locking ring having an upwardly facing tapered surface, and a cam ring having an annular tapered surface for camming cooperation with the locking ring surface. The locking ring is disposed on the hanger shoulder opposite an internal groove in the wellhead. The cam ring threadingly engages the hanger and is releasably attached to the running tool whereby upon rotation of the running tool, the cam ring moves downwardly on the hanger threads and cams the locking ring outwardly into the wellhead groove.

After removal of the holddown running tool, a seal assembly is lowered into the upper annular space around the hanger to close the annulus. The assembly includes a first tubular body threadingly connectable to the hanger, an outer load ring, an inner load ring, an inner packing ring disposed between the outer load ring and inner load ring, an inner retainer ring, and an outer packing ring disposed between the inner load ring and inner retainer ring. The inner packing ring singly engages the hanger and the outer packing ring singly engages the head. Such sealing occurs upon the shearing of a pin having relative vertical movement between the hanger and head. A running tool has threads for attachment to the hanger.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
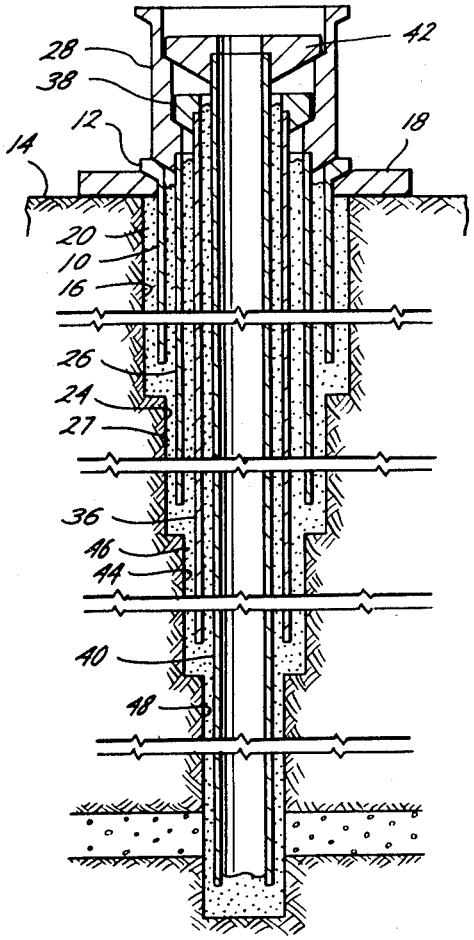
FIG. 1 is a schematic view of the cross section of suspended coaxial casing assemblies in an underwater well.

The present invention is an apparatus for locking within a wellhead a casing hanger suspending a string of casing or tubing in an oil and gas well. Although the present invention may be used in a variety of environments, FIG. 1 illustrates the environment of the present invention installed in an offshore well on the ocean floor. Such installations ordinarily include a series of coaxial assemblies including casing extending into the ocean floor supported by casing hangers mounted within a wellhead or casing head disposed on a base at the mudline.

Referring now to FIG. 1, a conductor casing 10 and head 12 have been lowered from a drilling means (not shown) such as a barge or bottom-supported platform and installed into the ocean floor 14. The conductor casing 10 may be driven or jetted into the ocean floor 14 until head 12 rests near the mudline, or if the bottom conditions so require, a bore hole 16 may be drilled for the insertion of conductor casing 10. A base structure 18 secured about the upper end of conductor casing 10 rests on the ocean floor 14, and the conductor casing 10 is enclosed within bore hole 16 by a column of cement 20 about at least a substantial portion of its length. A riser (not shown) clamped to head 12 extends from head 12 to the drilling means (not shown).

After drilling apparatus is lowered through the riser and conductor casing 10 to drill a new bore hole 24, surface casing 26, having a wellhead housing 28 attached to its upper end, is lowered through the riser and conductor casing 10 until housing 28 lands on head 12. Surface casing 26 has its lower end anchored within the well by cement 27. Casing head or wellhead housing 28 may be of various designs such as for suspending casing hangerheads which support other casing hangerheads or for supporting multiple casing hangers such as are shown in FIG. 1.

Pressure control equipment is releasably connected to the well either at the ocean floor or at the surface. When located at the surface, the equipment is mounted to the riser extending from the upper end of wellhead housing 28. When located at the ocean floor, the equipment (not shown) is connected directly to the upper end of wellhead housing 28, and has a riser (not shown) extending upwardly to the water's surface. Assuming the latter, such pressure control equipment includes one or more blowout preventors and forms a continuous bore of substantially the same diameter as the upper end of the bore of the wellhead housing 28. The details of the pressure control equipment and its riser are not important to the novel aspects of the present invention and therefore are not described in detail. It is sufficient to note that one or more casing strings may be lowered into and landed within wellhead housing 28 for suspension within the well, as hereinafter described while maintaining pressure control over the well.

Referring again to FIG. 1, intermediate casing 36 with casing hanger 38, and production casing 40 with casing hanger 42, are successively installed within the well. Bore hole 44 is first drilled into the ocean floor within which intermediate casing 36 is lowered and cemented as at 46 and then bore hole 48 is drilled for suspending and cementing production casing 40. Casing hanger 38 and casing hanger 42 are individually supported by wellhead housing 28.

Thus, the series of coaxial casing assemblies are installed in the well beginning with the outermost or conductor casing 10 and concluding with production casing 40. Generally, the installation includes drilling a bore hole having a diameter slightly greater than the casing to be installed and lowering the casing string from the drilling means through a riser and the previously installed casing and into the newly drilled bore hole. The casing is suspended from the wellhead housing by the casing hanger and the casing is anchored within the well by the cement.

One or more tubing strings would subsequently be installed inside the production casing if the well is out into production, and would be suspended and sealed using a tubing hanger and one or more packers to isolate the producing zone from one another. An assembly of production valves would then be connected to wellhead housing 28 in place of the pressure control equipment to control flow from the well.

Having now described the general environment of the present invention, it is now necessary to describe the cementing operation. It should be understood that a description of the cementing of one casing string will be illustrative of the method of cementing the other casing strings and therefore the following detailed description of the cementing of the intermediate casing 36 will be exemplary of that operation for surface casing 26 and production casing 40.

Figure 2:
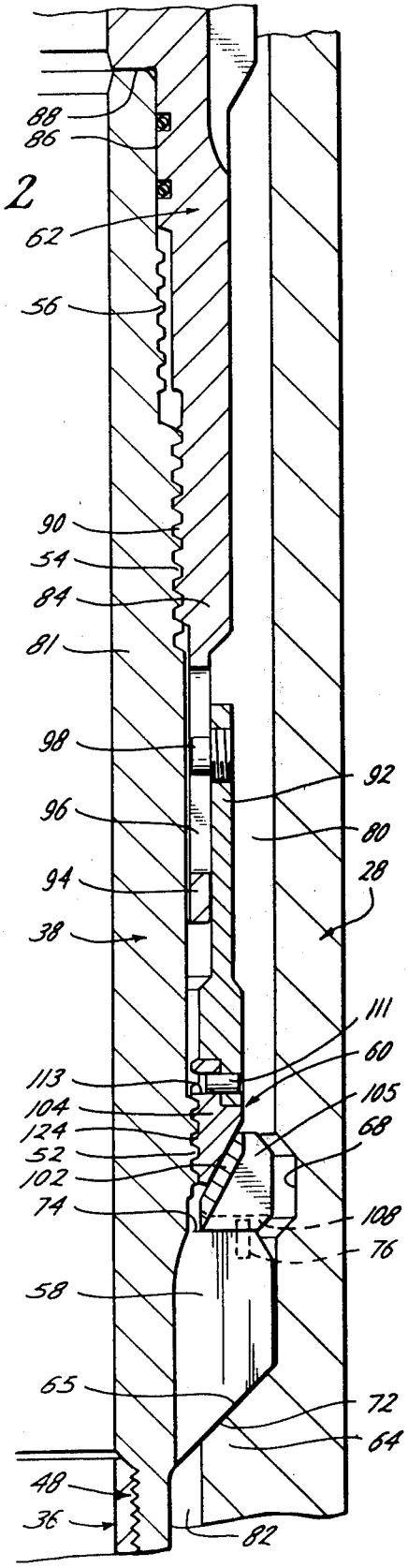
FIG. 2 is a section view of a portion of the hanger, head, running tool, and holddown assembly for the underwater well of FIG. 1.
Figure 2A:
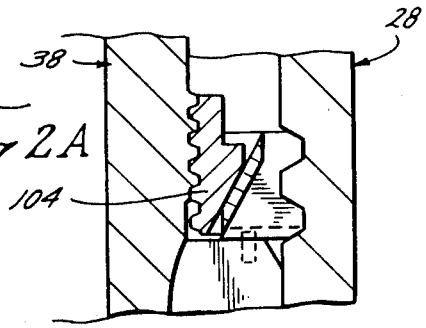
FIG. 2A is a section view of a portion of FIG. 2 illustrating a wellhead groove and locking ring having cooperable plural external frustoconical load-bearing surfaces.

Referring now to FIG. 2, wellhead housing 28 includes an internally projecting annular shoulder 64, forming a lower conical seat 65 having a generally upwardly facing ridge surface, and an annular holddown groove 68 spaced a predetermined distance above shoulder 64. Groove 68 may have a single upper and lower external frustoconical load-bearing surface or a plurality of upper and lower external frustoconical load-bearing surfaces as shown in FIG. 2A. A plurality of such surfaces is often necessary on some wellheads where very high blowout forces can exist. Hanger 38 includes a mandrel 81 having a threaded box at 48 at its lower end for threaded connection to the upper end of casing string 36. Above box 48, hanger 38 has a plurality of azimuthally-spaced ribs 58 formed by flow passages or flutes 70, shown in FIG. 3. The lower annular surface of ribs 58 forms an upper conical seat 72 adapted to engagingly mesh with lower conical seat 65 of shoulder 64.

Figure 3:
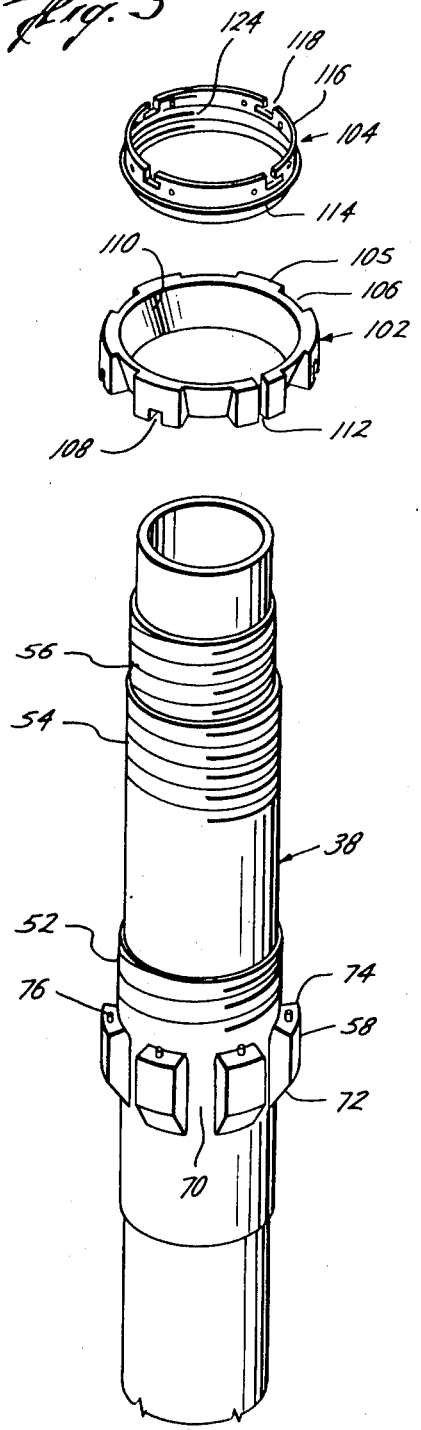
FIG. 3 is a perspective view of the hanger and the holddown assembly of the running tool of FIG. 2.

Referring now to FIGS. 2 and 3, ribs 58 also form an annular shoulder 74, each having an upwardly projecting pin 76. Hanger 38 includes right-hand threads 52 just above ribs 58 for effecting holddown assembly 60, described below, left-hand threads 54 above threads 52 for threaded engagement with running tool 62, also described below, and right-hand threads 56 above threads 54 for connection with a riser (not shown).

Running tool 62 includes a tubular body 84 having a counterbore 86 at its lower end. Counterbore 86 creates an internal annular shoulder 88 acting as a stop for engagement with the upper terminal end of hanger 38 and houses internal threads 90 about its midportion for connection to mating threads 54 on the exterior of hanger 38.

During installation, casing hanger 38, having surface casing 36 suspended from its lower end, is lowered by running tool 62, shown in FIG. 2, and seat 72 of ribs 58 are landed on seat 65 of inwardly projecting annular shoulder 64 in the bore of wellhead housing 28. With casing hanger 38 so landed, casing string 36 is suspended within surface casing 26 and bore hole 44 in spaced relation thereto creating an annulus thereabout which extends from the bottom of bore 44 to the surface. The annulus above flutes 70 formed by running tool 62 and wellhead housing 28 shall be defined as the upper annulus 80 and the lower annulus 82 shall be in the annulus below flutes 70.

The physical dimensions of hanger 38 and wellhead housing 28 and their various components is such that when seats 65, 72 engage, shoulder 74 will be approximately even with the lower portion of groove 68 in wellhead housing 28, and there will be a substantially clear passage from the upper annulus 80 above ribs 58 to the lower annulus 82 below ribs 58 through flow passages 70.

Hanger holddown assembly 60 is lowered into the well on hanger 38 with running tool 62 and may be actuated, as will be described hereinafter in detail, by a right-hand torque applied to the running tool drill string and transmitted to assembly 60. Upon actuation, assembly 60 positively locks seat 72 of ribs 58 against annular seat 65 of shoulder 64 on wellhead housing 28 thereby preventing the upward movement of hanger 38. Since the threads of the couplings comprising the running tool drill string are right-hand threads, the applied right-hand torque will not loosen such threads.

The present invention permits holddown assembly 60 to be actuated at will. In some cases it is desirable to reciprocate the casing during the cementing operation to increase the turbulance of the cement for a more complete clean-out of foreign material from the surfaces being cemented to obtain a better bond. Thus, it is an advantage to be able to latch the hanger down before, during, or after the cementing operation. As can be best visualized from FIG. 1, the drill pipe (not shown) extends from the casing hanger 38 to the surface so that cement may be pumped downwardly through the drill pipe and through casing 36 around the lower end of casing 36 and upwardly within lower annulus 82 around the exterior of casing 36. During the cementing operation, returns are taken upwardly through lower annulus 82, through flow passages or flutes 70, and into upper annulus 80.

Upon rotation of the running tool drill string after complete actuation of holddown assembly 60, shear means 111 shown in FIG. 2 disengages assembly 60 permitting it to continue to maintain positive holddown after disengagement of running tool 62. Threads 54 and 90 are left-hand threads so that right-hand rotation disengages handling tool 62 from hanger 38. In this manner after completion of the cementing operation, sufficient predetermined right-hand rotation detaches running tool 62 from hanger 38 and running tool 62 is withdrawn from wellhead housing 28. A seal assembly or packoff 100, hereinafter described in detail, is then lowered through the riser and onto mandrel 81 into annulus 80 for closing and sealing flow passages 70. The seal assembly 100 is lowered by means of another running tool suspended from the lower end of a drill string. In summary, the hanger holddown 60 holds hanger 38 down against wellhead housing 28 and the packoff assembly 100 seals off upper annulus 80 from lower annulus 82 closing flow passages 70. It is an especially desirable feature that the holddown operate entirely independent of the packoff assembly 100. Although the invention has been described as being installed and the holddown effected before the packoff is even run into the well, it should be understood that the holddown and packoff may be adapted to be combined and lowered into the well as a unit and be used together.

Referring now to FIG. 2, running tool 62 includes a tubular body 84 and a torque sleeve 92. Body 84 has an upper threaded box (not shown) in which the handling string is received and a lower threaded box having left-hand threads 90 which engage threads 54 of hanger 38. Torque sleeve 92 is telescopically received over a reduced diameter portion 94 at the lower end of body 84. Reduced diameter portion 94 includes vertical slots 96 for receiving torque pins 98 passing through the upper end of torque sleeve 92 and projecting into slots 96. Hanger holddown assembly 60 is mounted on the lower end of torque sleeve 92 whereby the reciprocal movements of pins 98 within slots 96 permit a vertical movement of hanger holddown assembly 60 with respect to running tool 62 and casing hanger 38.

Referring to FIGS. 2 and 3, holddown assembly 60 includes a latch ring 102 and locking ring 104. Latch ring 102 rests on the upper shoulder 74 of ribs 58 of hanger 38 and has ribs 105 defined by bypass grooves 106 which correspond to flow passages 70 of hanger 38. Each rib 105 has a radially-extending slot 108 on its lower surface for receiving pin 76 on each corresponding rib 72 of hanger 38 to prevent rotation of ring 102 with respect to hanger 38. Latch ring 102 further has a bevelled inner surface 110 and is split at 112 to permit expansion.

Locking ring 104 has internal right-hand threads 124 for threaded engagement with threads 52 of hanger 38. Ring 104 also includes shear pins 111 received by mating apertures 113 in the lower end of torque sleeve 92. A lower bevelled outer surface 114 on ring 104 meshes with bevelled inner surface 110 of latch 102. In this way, as locking ring 104 is tightened onto threads 52 by right-hand rotation, locking ring 104 moves downwardly causing mating cam surfaces 110, 114 to expand latch ring 102 radially, rotation of latch ring 102 being prevented by pins 76. Thus, when hanger 38 is positioned with respect to wellhead housing 28 as shown in FIG. 2, as locking ring 104 is tightened onto threads 52, latch ring 102 is expanded into groove 68 of housing 28 thereby holding hanger 38 down with respect to housing 28. Locking ring 104 further includes upwardly projecting annular flange 116 having a plurality of azimuthally-spaced J-slots 118 which may be engaged for a tool for ultimately releasing and removing the holddown assembly 60.

According to the operation of the holddown assembly 60 of FIGS. 2 and 3, hanger 38 is attached to the top of casing 36, latch ring 102 is placed over hanger 38 and rested on shoulder 74 of ribs 58 of hanger 38. Locking ring 104 is installed onto threads 52 by right-hand rotation and running tool 62 is threaded onto hanger 38 by left-hand rotation. Sleeve 92 is pinned to ring 104 by shear pins 111. The handling string is threaded into upper-threaded box of body 84 of running tool 62.

Hanger 38 is then lowered by means of the handling string until seat 72 of ribs 58 rest on seat 65 of shoulder 64 of wellhead housing 28. The handling string is then rotated in a right-hand direction causing locking ring 104 to thread onto threads 52 whereby latch ring 102 is cammed into groove 68 and hanger 38 is positively held down against wellhead housing 28. When locking ring 104 is threaded onto threads 52 to the maximum extent, shear pins 111 will shear, thus disconnecting running tool 62 and holddown assembly 60. During the time that locking ring 104 is being threaded onto right-hand threads 52, running tool 62 is threading off of left-hand threads 54. As right-hand rotation of the handling stringf continues, running tool 62 will eventually be threaded free of hanger 38 at which time the handling string and running tool 62 are raised from the well.

Holddown assembly 60 may be actuated prior to cementing casing 36 to insure a positive holddown before, during, and after the cementing operation. An independent holddown assembly without the seal assembly avoids subjecting the seal assembly to deterioration caused by the flow of cement in annulus 80. In prior art apparatus, the seal assembly was either subjected to the cement or the holddown assembly and seal assembly were lowered into the well after completing the cementing operation during which there was no positive holddown. A positive holddown is defined as a latch ring biased into engagement with a corresponding groove whereby the latch ring cannot be retracted by downhole pressure. Bypass groove 106 of latch ring 102, flow passages 70 of hanger 38, and bypass grooves 96 of running tool 62 permit the relief of pressure from annulus 82 during the cementing process.

Figure 4:
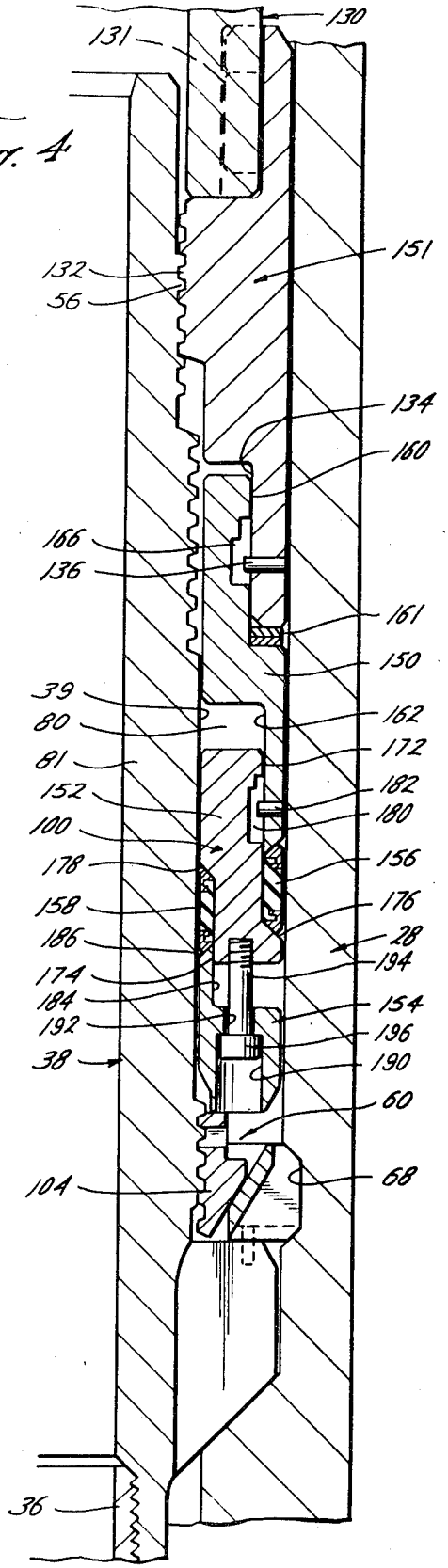
FIG. 4 is a section view of a portion of the hanger, head, running tool, and seal assembly for the underwater well of FIG. 1.

Referring now to FIG. 4 for a description of packoff assembly 100, after the cementing operation has been completed and running tool 62 has been removed, packoff assembly 100 is lowered into the well on running tool 130 to seal annulus 80 just above groove 68 in wellhead housing 28. Packoff assembly 100 includes an outer load ring 150, an actuating ring 151, inner load ring 152, inner retainer ring 154, outer packing ring 156, and inner packing ring 158.

Outer load ring 150 includes a reduced diameter portion 160 around its upper end and a counterbore 162 in its lower end. Actuating ring 151 has a counterbore 134 in its lower end for receiving reduced diameter portion 160 of outer load ring 150, and an internal J-slot 131 in its upper end to receive running tool 130. Bearing rings 161 are received by reduced diameter portion 160 to reduce friction with the lower end of actuating ring 151. Outer load ring 150 has an annular groove 166 which receives a plurality of pins 136 projecting through the internal wall of counterbore 134 of actuating ring 151. Outer load ring 150, and thus packing assembly 100, is mounted onto the lower end of actuating ring 151 by means of the engagement of pins 136 with the upper horizontal wall of annular groove 166 in ring 150. The lower terminus of outer load ring 150 has a forty-five degree chamfer creating a downwardly and outwardly facing surface for engagement with outer packing ring 156.

Inner load 152 has a reduced diameter portion 172 at its upper end and a counterbore 174 in its lower end. Reduced diameter portion 172 forms a conical seat 176 at a forty-five degree angle with the external axial wall of portion 172. Conical seat 176 forms an upwardly and outwardly facing surface for engagement with outer packing ring 156. Counterbore 174 forms seat 178 having a forty-five degree angle with the internal axial wall of counterbore 174. The conical shoulder 178 has a downwardly and inwardly facing surface for engagement with inner packing ring 158. Reduced diameter portion 172 of inner load ring 152 is received within counterbore 162 of outer load ring 150. Outer load ring 150 and inner load ring 152 are connected together by means of an annular groove 180 in the axial wall of reduced diameter portion 172 of inner load ring 152 which receives a plurality of roll pins 182 projecting from the internal surface of the axial wall of counterbore 162 of outer load ring 150. Groove 180 has an axial length substantially greater than the diameter of pins 182 thereby permitting axial movement of outer load ring 150 with respect to inner load ring 152. The internal diameter of reduced diameter portion 172 of inner load ring 152 is greater than the outer diameter of mandrel 81 and the outer diameter of portions 172 is less than the inner diameter of counterbore 162 of outer load ring 150.

Inner retainer ring 154 has a reduced diameter portion 184. The upper end of inner retainer ring 154 includes a conical seat 186 having a forty-five degree angle with the internal axial wall of ring 154, the seat having an upwardly and inwardly facing surface for engagement with inner packing ring 158. Reduced diameter portion 184 is received within lower counterbore 174 of inner load ring 152. Inner load ring 152 and inner retainer ring 154 are connected together by connection means which includes a plurality of downwardly facing countersinks 190 and a plurality of unthreaded passageways 192 through inner retainer ring 154, and a plurality of bolts 194 each having a head 196 disposed within a countersink 190 and a shaft extending through a passageway 192 and threaded into a blind hole. The length of reduced diameter portion 184 when inserted into counterbore 174 produces a gap between inner load ring 152 and inner retainer ring 154 to permit axial movement of the compression members with respect to one another.

The entire packoff assembly 100 is lowered into the well by means of a riser which is connected to running tool 130 which in turn supports packoff assembly 100. As the riser and packoff assembly 100 are lowered into the well, roll pins 136, 182 will bear against the upper surfaces of grooves 166, 180, respectively, and heads 196 of bolts 194 will bear against the upper surface of countersinks 190. In such a condition, packing rings 156, 158 are minimally compressed.

As actuating ring 151 is threaded onto hanger 38 by threads 132 of ring 151 and upper threads 56 of hanger 38, the lower end of inner retainer ring 154 contacts the upper end of locking ring 104 whereby further axial movement of inner retainer ring 154 is prevented.

Further threading of actuating ring 151 onto hanger 38 causes further axial movement of outer load ring 150 with respect to inner retainer ring 154. Inner packing ring 158 contacts the sealing surface of hanger 38 first and because of its smaller cross section, provides a higher loading per unit area.

By virtue of inner load ring 152, the rate of compression of packing rings 156, 158 with respect to one another can vary. As a result, even when one seal assembly is fully compressed, compression of the other seal assembly may continue. In this way, both packing rings can be fully compressed even though the compression characteristics of such packing rings vary in size with respect to one another, and even when one packing ring is required to fill a larger gap than the other.

While a prepared embodiment of the invention has been shown and described, modifications thereof can be made by one skilled in the art without departing from the spirit of the invention.

I claim:

1. A well apparatus for preventing axial movement of a hanger within a wellhead, the hanger having a shoulder supported by a seat in the bore of the head, the shoulder having an upper annular surface, the head having a holddown groove in the wall of the bore spaced above the seat, comprising:

expansible means including a latch ring radially slidably disposed on an upper annular surface of said hanger shoulder adjacent said holddown groove for expanding into locking engagement with such holddown groove of the head, said latch ring and said holddown groove having abutting shoulders which prevent relative axial motion therebetween when said latch ring engages said groove, said latch ring having a bevelled inside diametral surface;

cam means including a locking ring threadedly connected to said hanger with first threaded means and having a bevelled outside diametral surface shaped correlatively to said bevelled surface of said latch ring and in axially slidable engagement therewith for camming said latch ring radially outwardly into locking engagement with the holddown groove of the head when the first threaded means are made up; and actuation means for actuating said locking ring into camming engagement with said latch ring, said actuation means including a tubular body threadedly connected to the hanger above said locking ring with second threaded means, said second threaded means being opposite-handed to said first threaded means; a torque sleeve telescopically slidably disposed on said body, there being an axial lost motion connection between said sleeve and said body which permits limited relative axial movement of said sleeve and said body but prevents relative motion therebetween; and shear means releasably connecting said sleeve to said locking ring, so that when said body is rotated so as to make up said first threaded means to actuate said latch ring, said second threaded means are loosened so as to disconnect said body from said hanger whereby said expansible means engages the head to prevent the axial movement of the hanger within the head.

2. The apparatus of claim 1 wherein said locking ring of said cam means includes release means including an upwardly projecting annular flange having at least one j-slot therein for permitting said locking ring to be engaged by a tool and rotated so as to loosen said first threaded means an amount sufficient for permitting said latch ring of said expansible means to contract into a nonengaging position.

3. The apparatus of claim 1 wherein said latch ring of said expansible means is an annular metal member having flow passages therethrough.

4. The apparatus of claim 3 wherein said metal member is a rigid split ring and said bevelled inside diametral surface is upwardly facing.

5. The apparatus of claim 3 further including alignment means for aligning said metal member on said hanger shoulder, said alignment means including an upwardly extending pin on said upper annular surface of said hanger shoulder and a radially extending groove in the lower face of said metal member, said pin being slidably received in said groove.

6. A well apparatus comprising:

a hanger for suspending a string of pipe into a well, said hanger having a shoulder thereon;

a head having a seat engageable with said shoulder and a groove disposed above said seat;

a metal member slidably engageable with said groove and said shoulder, the axial thickness of said shoulder and said metal member being almost equal to the distance that said groove is disposed above said seat; and a locking ring insertable between said metal member and said hanger to prevent said metal member from sliding into nonengagement with said groove, said locking ring including actuating means cooperable with said hanger for inserting said locking ring between said metal member and said hanger, said actuating means including tool means engageable with said hanger for lowering same into the well, said tool means including means for disengaging from said hanger as said actuating means inserts said locking ring between said metal member and said hanger, whereby said groove and said seat trap said metal member and said shoulder therebetween thereby preventing any vertical movement of said hanger with respect to said head.

7. A casing hanger holddown apparatus lowerable into the bore of a wellhead having a seat and a holddown groove within the bore, comprising:

a casing hanger having a shoulder thereon for landing on the seat in the wellhead bore and means for suspending a casing from its lower end, said casing hanger shoulder having an upper annulus surface;

a casing hanger running tool having a body threadingly engaged to said casing hanger by left-hand threads and a holddown assembly reciprocably disposed on said casing hanger running tool, said holddown assembly including a torque sleeve slidably telescoped over the lower end portion of said body, said lower end portion of said body having a longitudinally extending slot therein and said sleeve having a radially inwardly extending pin disposed thereon, said pin being received in said slot;

said holddown assembly having a threaded holddown ring releasably disposed on the lower end of said sleeve, said holddown ring and said sleeve having shear means disposed therebetween for releasably connecting said ring and said sleeve together, said holddown ring being threadingly engaged to said casing hanger by right-hand threads; and a slotted expanding holddown latch slidably disposed on said upper annular surface of said casing hanger shoulder adjacent said holddown groove and engaging said holddown ring, said latch and said ring having cooperating conical wedging surfaces adapted to force said latch radially outwardly upon said ring moving downwardly on said casing hanger, whereby upon righthand rotation of said casing hanger running tool said holddown ring is threaded further onto and moves downwardly on said righthand threads, camming said expanding holddown latch outwardly into locking engagement with the holddown groove in the wellhead.

8. The casing hanger holddown apparatus of claim 7 wherein said casing hanger includes right-hand threads disposed above and radially inwardly of said left-hand threads for engagement with a sealing assembly running tool.

9. Wellhead apparatus comprising:

a casing head having a bore therethrough with an upper cylindrical portion, said cylindrical portion having a seat at its lower end and an annular groove above said seat;

a casing hanger having a shoulder landable on said seat for suspending a casing string from its lower end, said shoulder having an upper annular surface, said casing hanger having first threaded means thereon;

means providing flow passages connecting annular spaces between the hanger and bore above and below the seat;

an assembly lowerable within said bore for anchoring said casing hanger within said casing head, said assembly including a running tool having a tubular body, a metal tubular sleeve reciprocably telescopingly disposed on the lower end of said running tool body, said sleeve and said body having lost motion connection means therebetween for permitting limited relative axial movement of said sleeve and said body and for preventing relative rotation therebetween, an annular metal locking ring releasably connected to the lower end of said sleeve, second threaded means on said locking ring for cooperatively engaging said first threaded means on said hanger for moving said locking ring downwardly upon rotation of said running tool; and a rigid, radially expansible latch ring carried on said upper annular surface of said casing hanger shoulder and adjacent said annular groove, said latch ring and said locking ring having correlatively shaped conical camming surfaces thereon slidingly engageable with each other and adapted to force said latch ring radially outwardly upon said locking ring being moved vertically downwardly with respect to said casing head upon rotation of said running tool, said latch ring thereby being expanded outwardly into locking engagement with said groove, the upper end of said groove and the upper outer edge of said latch ring having cooperable shoulders thereon for preventing relative axial motion between said ring and said groove.

10. The wellhead apparatus of claim 9 wherein the upper end of said groove in said bore tapers upwardly and inwardly forming said shoulder of said groove, and the upper outer edge of said rigid latch ring has a correlatively tapering surface forming said shoulder of said latch ring corresponding to the upper end of said groove.

11. The wellhead apparatus of claim 10 wherein said sleeve is releasably disposed about the upper end of said metal locking ring, and said metal locking ring is disposed above said rigid latch ring, said metal locking ring having an inwardly and downwardly tapering surface on its lower end forming its conical camming surface engaging a correspondingly tapered surface on the upper end of said rigid latch ring forming its conical camming surface.

12. A well apparatus for preventing axial movement of a hanger within a wellhead, the hanger having a shoulder supported by a seat in the bore of a head, the shoulder having an upper annular surface, the head having a holddown groove in the wall of the bore spaced above the seat, comprising:

an expandable ring disposed on the upper annular surface of said hanger shoulder adjacent said groove for expanding into locking engagement with said holddown groove for preventing relative axial motion therebetween, said ring having a tapered surface;

a locking ring having first connection means connected to said hanger and a tapered surface shaped correlatively to said tapered surface of said expandable ring and in sliding engagement therewith for camming said expandable ring outwardly into said groove when the first connection means is made up; and actuation means for actuating said locking ring into camming engagement with said expandible ring, said actuation means including a body having second connection means connected to said hanger; a member disposed on said body and engaging said locking ring for transmitting force from said body to said locking ring for making up said first connection means; and cooperable means on said body, said member and said hanger for disconnecting said second connection means as said first connection means is made up.

13. The apparatus of claim 12 wherein said locking ring includes release means having a slot for permitting said locking ring to be engaged by a tool and moved away from engagement with said expandable ring for permitting said expandable ring to contract into a non-engaging position.

14. The apparatus of claim 12 wherein said expandable ring is an annular metal member having flow passages therethrough.

15. The apparatus of claim 14 wherein said metal member is a rigid split ring and said tapered surface faces upwardly.

16. The apparatus of claim 14 further including alignment means on said expandible ring and said surface of said hanger shoulder for engaging each other for aligning said expandable ring on said hanger shoulder.

* * * * *